US006439103B1

(12) United States Patent
Miller

(10) Patent No.: US 6,439,103 B1
(45) Date of Patent: Aug. 27, 2002

(54) HYDRAULIC AND PNEUMATIC CYLINDER CONSTRUCTION

(75) Inventor: Gary L. Miller, Chaska, MN (US)

(73) Assignee: Vector Engineering Co., Chaska, MN (US)

( * ) Notice: Subject to any disclaimer, the term of this patent is extended or adjusted under 35 U.S.C. 154(b) by 0 days.

(21) Appl. No.: 09/656,767

(22) Filed: Sep. 7, 2000

Related U.S. Application Data

(60) Provisional application No. 60/152,663, filed on Sep. 7, 1999.

(51) Int. Cl.[7] ..... F01B 29/00
(52) U.S. Cl. ..... 92/128; 92/169.1
(58) Field of Search ..... 92/128, 164, 169.1

(56) References Cited

U.S. PATENT DOCUMENTS

| | | | | | |
|---|---|---|---|---|---|
| 2,956,302 | A | | 10/1960 | Rolph et al. | 16/59 |
| 2,987,046 | A | | 6/1961 | Atherton | 121/38 |
| 3,136,230 | A | * | 6/1964 | Buckley | 92/128 |
| 3,474,710 | A | | 10/1969 | Stryker | 92/128 |
| 3,494,652 | A | | 2/1970 | Langland | 292/256.63 |
| 3,881,401 | A | * | 5/1975 | Bimba | 92/169.1 |
| 4,187,766 | A | * | 2/1980 | Gaylord | 92/169.1 |
| 4,785,721 | A | | 11/1988 | Leigh-Monstevens et al. | 92/171 |
| 5,085,131 | A | | 2/1992 | Barrett et al. | 92/169.1 |
| 5,203,250 | A | * | 4/1993 | Sundberg | 92/129 |
| 5,375,507 | A | | 12/1994 | Kladiwa et al. | 92/128 |
| 5,487,326 | A | | 1/1996 | Owens | 92/128 |
| 5,507,218 | A | * | 4/1996 | Lipinski | 92/164 |
| 5,680,808 | A | * | 10/1997 | Day et al. | 92/169.1 |
| 5,715,740 | A | | 2/1998 | Sims | 92/128 |
| 6,101,922 | A | * | 8/2000 | King | 92/164 |

* cited by examiner

*Primary Examiner*—Edward K. Look
*Assistant Examiner*—Thomas E. Lazo
(74) *Attorney, Agent, or Firm*—Larkin, Hoffman, Daly & Lindgren, Ltd.; Frederick W. Niebuhr

(57) ABSTRACT

A fluid actuator includes a cylindrical housing with a flared open end and an opposite end having a diameter less than the flared end. A rod cap is insertable into the housing at the open end, and moveable through the housing to the opposite end where it is contained by an annular rim welded to the housing. A piston and piston rod assembly is inserted into the housing through the open end. A blind end cap, also insertable into the housing at the open end, is releasably secured near the open end to substantially close the housing. The piston is reciprocable in the housing between the rod cap and the blind end cap. The housing incorporates a conical ramp portion between the flared end and the smaller diameter end of the housing, to provide a gradual transition between the larger and smaller diameters. The ramp tends to center the components as they are inserted, and gradually and evenly compresses elastomeric seals of the components during their insertion, to better preserve the integrity of the seals. The rim is welded to the opposite end before insertion of the components, to avoid heat damage to the seals and permit painting or plating of the housing/rim combination before assembly. One (single acting) or two (double acting) passages, through the housing or through one or both of the end caps, are provided for supplying air or hydraulic fluid under pressure to the housing, to extend and/or retract the cylinder. In alternative embodiments, the positions of the rod cap and blind end cap are reversed, and the housing has a uniform diameter rather than a flared end.

67 Claims, 5 Drawing Sheets

HYDRAULIC AND PNEUMATIC CYLINDER CONSTRUCTION

This application claims the benefit of priority based on Provisional Application No. 60/152,663 entitled "Hydraulic and Pneumatic Cylinder Construction," filed Sep. 7, 1999.

BACKGROUND OF THE INVENTION

Hydraulic and pneumatic cylinders have long been used in applications requiring high mechanical forces in locations that lack space for motors or engines capable of generating such forces. Transmitting force by hydraulic fluid or pneumatic gas and a cylinder is a common practice in many industries. With the advent of computer controls in hydraulic systems, such systems are required to perform increasingly challenging functions in a wide variety of industries and applications. As newer, high volume, computer controlled, low cost applications emerge, hydraulic systems are appearing in markets requiring "maintenance free" performance, free of noise, repairs and fluid leaks. Leaks of hydraulic fluid, even drops over the product lifetime, may constitute a hazard. These newer applications require cylinders to evolve from heavy-duty efficient transmitters of extreme forces, or from low volume, low reliability disposable cylinders, to high reliability and low cost cylinders capable of being produced repeatably in large quantities.

Conventional cylinder constructions involve variations on the basic cylinder components: rod, piston with piston seal, rod cap with seals, cylinder tube and cylinder blind end cap. Rod and blind end caps typically are attached to the cylinder tube by threads, welding, retaining rings or crimping. Non-welded cylinders generally require elastomeric seals to contain the hydraulic fluid. Conventional cylinder construction techniques have inherent reliability or cost problems when used in high volume applications. Welded cylinders must be extensively tested prior to shipping. Excessive heat during welding creates a risk of heat damage to specialized seals and other components. Threaded cylinders require extensive machining, need additional machined features to protect seals during assembly, present difficulties in maintaining concentricity between the separate cylinder components, and involve many assembly steps. Ring-retained and crimped cylinders follow basically the same manufacturing and assembly steps as threaded cylinders. They require less machining and provide for easier assembly, but have lower performance limits. Producing cylinders in high volumes with high reliability requires controlling the cylinder design and manufacturing processes to obtain a high degree of product acceptance without depending on final testing.

Therefore, it is an object of the present invention to provide a fluid actuator cylinder design that provides a high degree of reliability at relatively low cost.

Another object is to provide a hydraulic or pneumatic cylinder having the high performance characteristics associated with welded and threadedly attached end caps, while avoiding the high cost and difficulties associated with welded and threaded end caps.

A further object is to provide an improved process for assembling a fluid actuator cylinder.

Yet another object is to provide, in a fluid actuator, a cylindrical enclosure that incorporates an end cap or end closure containment feature that is asymmetrical in the sense of exerting a greater force on the end cap or other member in the axial direction that requires more force, i.e. the direction opposite to the force applied to the end cap by pressurized fluid when the actuator is in use.

SUMMARY OF THE INVENTION

To achieve these and other objects, there is provided an actuator enclosure for containing a reciprocating piston. The enclosure includes the cylindrical housing defining a chamber including a first region, a second region opposite the first region and including an open end of the housing, and a medial region between the first and second regions. A first end closure member is insertable in a first axial direction into the chamber through the open end. The first closure member is shaped for a conforming and contiguous surface engagement with the housing at a first predetermined location along the first region. A second end closure member also is insertable in the first axial direction into the chamber through the open end. The second end closure member is shaped for a conforming and contiguous surface engagement with the housing at a second predetermined location along the second region. A closure member containing structure, integral with the housing, is positioned to engage the first closure member substantially upon a complete insertion thereof to the first predetermined location, thereby to prevent further travel of the first closure member in the first axial direction. The housing is adapted to accommodate a piston for reciprocation along the medial region of the chamber. A selected one of the first and second closure members includes an opening adapted to slideably support a piston rod coupled to the piston.

The preferred closure member containing structure is an annular rim welded to an edge of the housing adjacent the first region, and extended radially inwardly from the housing. The rim thus acts as a stop, preventing the end cap or other closure member from moving any further in the first axial direction after it encounters the rim. Because the rim is welded to the cylindrical housing, it provides the retaining strength of a welded end cap. As a result the actuator enclosure is usable in applications requiring, among conventional cylinders, either threaded or welded end caps. At the same time, the extensive machining required of threaded cylinders and end caps is avoided.

With respect to conventional welded cylinders, a considerable advantage arises from the fact that the annular rim can be welded to the cylindrical housing before insertion of the end cap or other closure member. Consequently, there is no risk of heat damage to specialized seals or other internal cylindrical components during welding.

A closure member mounting device, e.g. a retaining ring, can be used to releasably secure the end cap against movement in the second, opposite axial direction away from its predetermined location. More particularly, a portion of the end closure member can extend beyond the first end region of the housing, in which case the retaining structure can include a groove formed circumferentially about the closure member and a retaining ring removably mounted within the groove. The retaining ring is relatively weak compared to the welded annular rim, exerting considerably less force upon the closure member. However, force in opposition to the retaining ring, caused primarily by friction of the piston rod during retraction when the closure member provides the rod cap, is considerably less than the force of pressurized fluid against the end cap when the piston rod is extended.

The invention affords a "hybrid" construction technique combining the strength of welded cylinders, the sealing reliability of elastomeric seals, and the assembly ease of ring-retained cylinders. In one version, the rod end cap of the cylinder is retained in the cylinder tube by a welded ring. This welded ring gives the cylinder the strength of a welded cylinder for withstanding maximum operating pressures while eliminating the need to rely on the weld as a hydraulic seal. The ring can be welded onto the cylinder tube prior to assembly, eliminating heat damage to the seals and other internal cylinder components during welding. The cylinder tube/ring combination can be painted or plated prior to assembly for corrosion resistance without the special handling required for a completed cylinder.

The blind end of the cylinder preferably is flared to allow convenient assembly of all cylinder components through the cylinder blind end. This flaring eliminates sharp or abrupt edges that can damage a seal during assembly. The rod cap and seals, the rod, the piston and piston seals are all assembled through the flared end of the cylinder. Consequently, there is virtually no chance of seal damage during cylinder assembly. Reliability and performance are enhanced, because concentricity between the rod and piston bearing surfaces in the rod end cap and tube are aligned during assembly by the cylinder tube itself, and can be completely controlled to very close tolerances by CNC (computer numerical controlled) machining operations in manufacturing the separate component parts. There is no need to rely on assembly techniques or fixturing to maintain proper alignments. This eliminates cylinder binding. Cylinder performance can be controlled by statistical control or other process control techniques during manufacturing of the separate cylinder components. By transferring the controlling factors to the component manufacturing level, reliability is improved. Manufacturing becomes easier because it is more controllable, and assembly can be rapid and repeatable. The resulting cylinders are far more economical and reliable.

Preferably the first end closure member provides the rod end cap, and the second end closure member provides the blind end cap. The blind end cap, accommodated in the flared end of the preferred housing, is larger in diameter than the rod end cap. The blind end cap does not require an axial opening therethrough to accommodate the piston rod. Accordingly, a transverse opening can be formed through the blind end cap to accommodate a pin used to support the actuator and at the same time releasably mount the blind end cap within the housing, specifically by a simultaneous extension of the pin through the blind end cap opening and two openings through the housing, on opposite sides of the housing that align with the blind end cap opening when the end cap is at its predetermined location. The pin can be secured by two bushings, one inserted through each of the housing openings into the end cap opening. As with the rod, piston and rod cap, the blind end cap has a seal located inwardly of the flare to ensure maximum seal integrity. Ultimate cylinder strength, rating and safety factors become functions of the blind end attachment and the parameters under which the cylinder is used in each application.

Another aspect of the present invention is a process for assembling a fluid actuator, comprising the following steps:

a. providing a cylinder having first and second opposite open ends, a first diameter over a majority of its length including the first end, a second diameter larger than the first diameter along an end region of the cylinder including the second end, and a transition region providing a gradual transition between the first diameter and the second diameter;

b. securing an end cap containment feature with respect to the first end of the cylinder;

c. inserting a first end cap into the cylinder through the second end, and moving the first end cap in a first axial direction along the cylinder until it contacts the containment feature and substantially closes the first end upon reaching a first predetermined location within the cylinder;

d. after so inserting the first end cap, inserting a piston into the cylinder through the second end, and moving the piston in the first axial direction along the cylinder to a location beyond the transition region;

e. after so inserting the piston, inserting a second end cap into the cylinder through the second end to a second predetermined location to substantially close the second end; and f. extending the piston rod from the piston, through an opening provided through a selected one of the end caps, to a piston rod termination outside of the cylinder.

In the Drawings

For a further understanding of the invention and its features and advantages, reference is made to the following detailed description and to the drawings, in which.

DETAILED DESCRIPTION OF THE PREFERRED EMBODIMENTS

Figure 1:
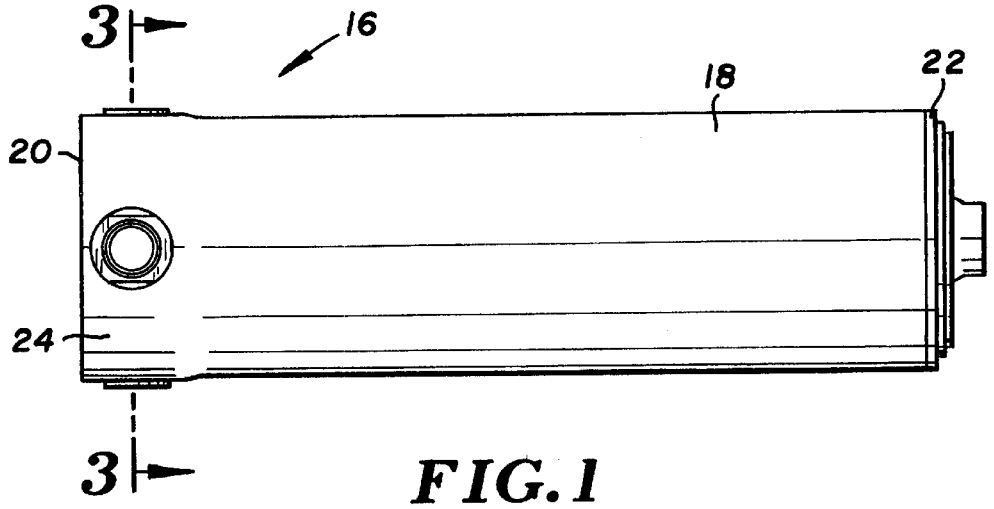
FIG. 1 is a side elevation of an actuator constructed in accordance with the present invention.
Figure 2:
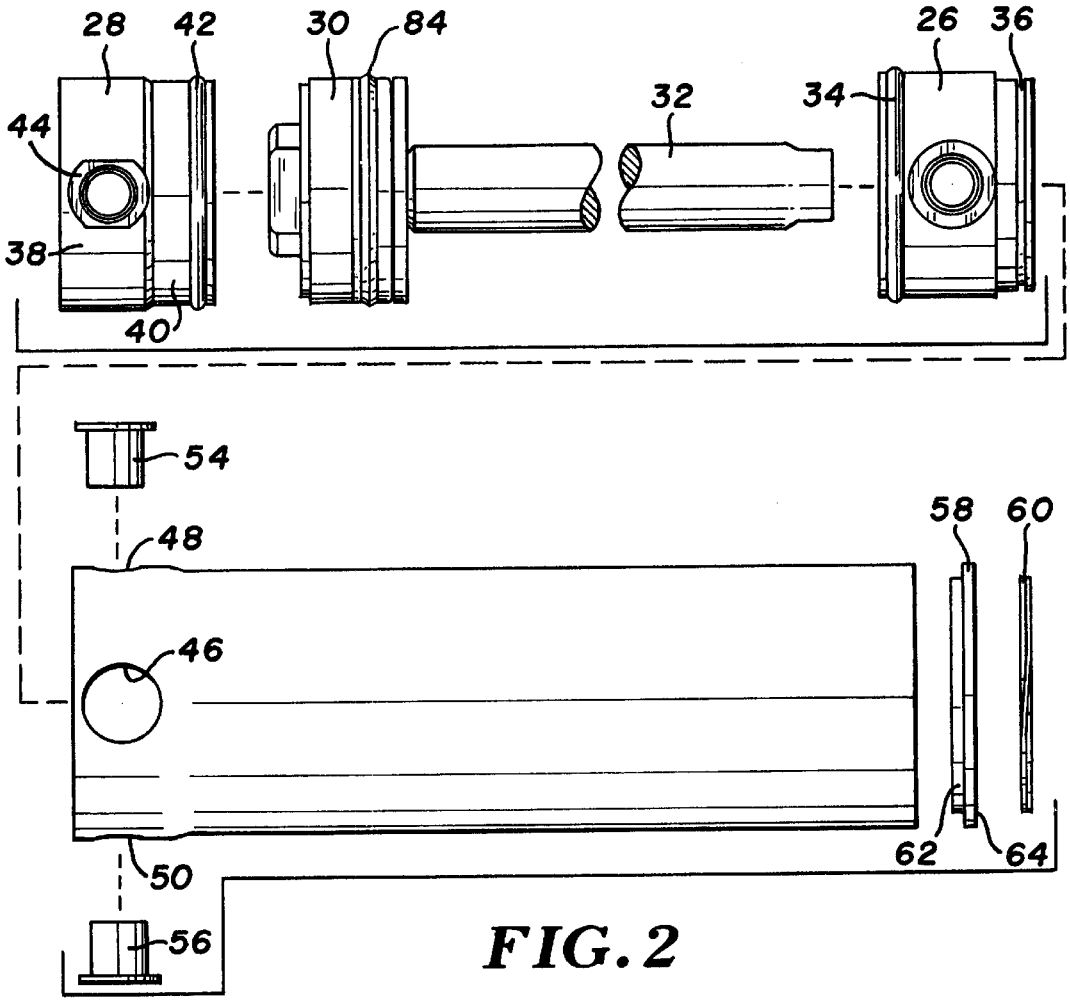
FIG. 2 is an exploded-parts view of the actuator.

Turning now to the drawings, there is shown in FIGS. 1 and 2 a fluid actuator 16. The actuator includes an elongate cylindrical tube or housing 18 having opposite open ends 20 and 22. Housing 18 is formed of steel, stainless steel, or aluminum and has a substantially uniform wall thickness. At end 22 and over most of its length, the housing has a substantially constant diameter. However, along a flared end region 24 that includes end 20, the housing is flared to provide a larger diameter at housing end 20 and the adjacent region.

Several components of the actuator are contained inside the housing when the actuator is assembled. These include a rod end cap 26, a blind end cap 28, and a piston assembly that includes a piston 30 and a piston rod 32. Rod cap 26, like housing 18, is circular in transverse profile, and has an outside diameter slightly less than the inside diameter of the housing near end 22, to provide a conforming, contiguous surface engagement with the housing. A seal 34, in the form of an elastomeric ring surrounding the rod cap, provides a fluid tight seal between rod cap 26 and housing 18 when the rod cap is contained within the housing. Near the opposite end of the rod cap is a circumferential groove 36.

Blind end cap 28 also has a circular profile, and a diameter selected for a tight fit (conforming and contiguous surface engagement) with the inside surface of the housing along flared end region 24, at least along an outer portion 38 of the blind end cap. An inside portion 40 of end cap 28 extends inwardly of the flared region, and accordingly has a diameter substantially the same as that of rod cap 26. A circumferential groove in portion 38 contains an elastomeric ring seal 42. A fitting 44 is provided for coupling to a supply line that provides a hydraulic fluid (or air in the case of a pneumatic actuator) to the interior of the housing.

Piston 30 has a diameter slightly less than that of rod cap 26, to provide a close fit of the piston within the housing, yet provide axial reciprocation of the piston within the housing.

Along flared end region 24, several openings are formed through the housing, including an opening 46 to accommodate fitting 44, and two opposed openings 48 and 50. When blind end cap 28 is inserted into the housing as shown in FIG. 1, opening 46 accommodates the fitting, while opposed openings 48 and 50 are aligned with an opening 52 (FIG. 3) that runs transversely through the blind end cap. When the openings are aligned, bushings 54 and 56 are pushed through openings 48 and 50, respectively, then into the blind end cap opening, thus to secure the blind end cap with respect to the housing.

Shown to the right of housing 18 in FIG. 2 are an annular rim 58 and a snap ring 60. Rim 58, preferably formed of steel, includes an inside segment 62 having a diameter substantially the same as but less than the inside diameter of housing 18 at end 22, and an outside segment 64 with a diameter substantially equal to the outside diameter of the housing. Thus, rim 58 fits snuggly against end 22 and the inside surface of the housing near end 22, leaving only segment 64 visible in the assembled actuator as seen in FIG. 1. A central opening in annular rim 58 permits piston rod 32 to extend outwardly of the housing. Rod 32 is shown in the retracted position. Rim 58 preferably is secured to the housing by welding, for maximum capacity to resist axially outward (rightward) movement of rod cap 26 away from its assembled position shown in FIG. 1.

As seen from FIG. 1, the opening in rim 58 not only allows piston rod 32 to extend rightwardly away from the housing, but further is sufficiently large to accommodate an extension of rod cap 26 beyond the housing. Such extension positions groove 36 slightly beyond end 22 of the housing. Rod cap 26 is maintained in the assembled position by inserting snap ring 60 into the groove, whereupon the snap ring encounters housing end 22 to resist leftward movement of the rod cap away from its assembled position.

Rim 58 and snap ring 60 thus cooperate to releasably secure rod cap 26 within housing 18. The rim and snap ring provide an advantageous combination of strength and convenience. Strength is provided by the welded rim in the direction required, i.e. to resist the tendency of rod cap 26 to slide outwardly (rightwardly) when pressurized hydraulic fluid or air enters the housing to extend the piston and piston rod. During retraction, rod cap 26 is urged inward (to the left), primarily due to friction between the rod cap and the piston rod. Snap ring 60 is sufficient to resist this force, which is considerably less than the oppositely directed force from the pressurized fluid.

Figure 3:
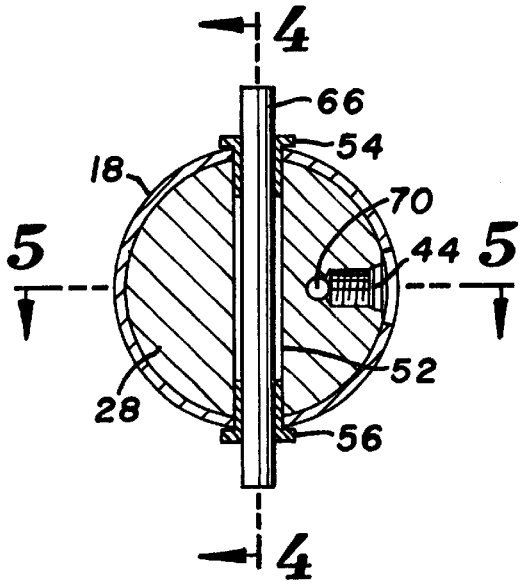
FIG. 3 is a sectional view taken along the line 3—3 in FIG. 1.
Figure 4:
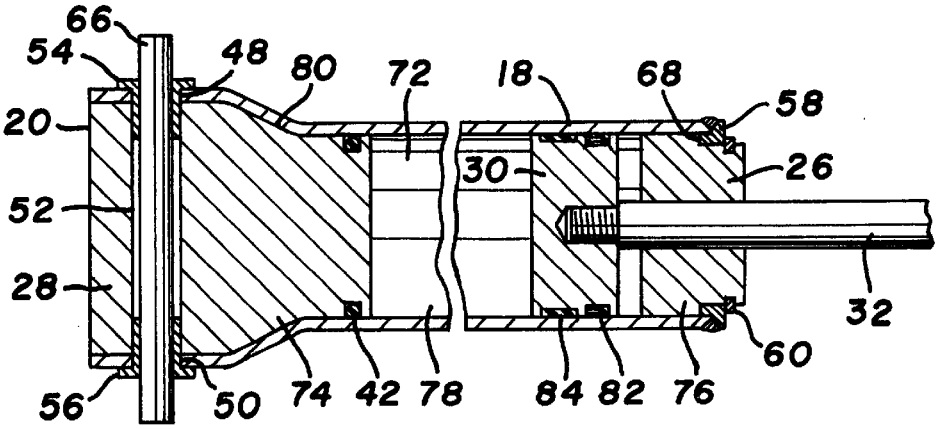
FIG. 4 is a sectional view taken along the line 4—4 in FIG. 3.
Figure 5:
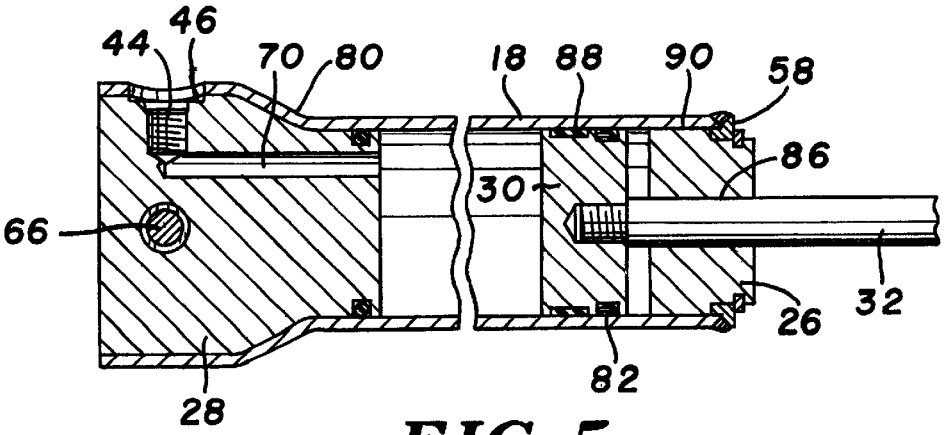
FIG. 5 is a sectional view taken along the line 5—5 in FIG. 3.

FIGS. 3–5 are sectional views of the assembled actuator, showing various components inside housing 18. FIG. 3 shows transverse opening 52 extended through blind end cap 28. This figure also shows a fluid passage 70 in communication with fitting 44, to conduct hydraulic fluid or air to the inside of the housing through the blind end cap. A clevis-type pin 66 extends through opening 52 and openings 48 and 50 through housing 18, supported by bushings 54 and 56 in a manner that facilitates a pivoting of the actuator about a longitudinal axis of pin 66. Rod cap 26 is assembled through flared end 20 and completely through tube 18 until a rod cap shoulder 68 contacts annular rim 58. Rod cap 26 is restrained against rim 58 by retaining ring 60. Ring 60 only needs to resist the friction forces of rod 32 during cylinder retraction. The welded rim provides resistance to internal hydraulic forces to the limit of the weld.

As seen in FIGS. 4 and 5, housing 18 defines an inside chamber 72 that conveniently can be considered to include three regions: an end region 74 corresponding to flared end 20, an opposite end region 76 occupied by rod cap 26 in the assembled actuator, and a medial region 78 that provides the volume for piston reciprocation.

Actuator 16 is single acting, with hydraulic (or pneumatic) fluid supplied only to the cylinder chamber medial region to the left of the piston as viewed in FIGS. 4 and 5, i.e., between the blind end cap and the piston. Thus, the supply of fluid through passage 70 extends the cylinder by moving the piston and rod rightward. The piston and rod return (move leftward) under the force of a load on the rod, not shown. Alternatively, a return spring can be provided in the chamber between the piston and the rod end cap. Such a spring is compressed when the cylinder is extended, and provides a restoring force to return the piston.

FIGS. 4 and 5, in somewhat exaggerated form, illustrate a conical ramp 80 that provides a transition region from the larger diameter flared end 20 to the smaller diameter remainder of the housing. Ramp 80 facilitates a more rapid assembly of the actuator, while more effectively preserving the integrity of certain components, particularly the elastomeric seals. The major components, i.e. end caps 26 and 28 and the piston assembly, are inserted into housing 18 through end 20 rather than end 22. In fact, in the preferred process annular rim 58 is welded to housing end 22 before the major components are inserted, and thus ensures that the major components can be inserted only at the flared end.

Assembly through the flared end is easier, first because the larger housing diameter at the flared end reduces the need for a careful, precise coaxial alignment of each component before its insertion. The larger diameter housing readily "captures" the lead portion of the component being inserted. As the component is inserted further, it encounters conical ramp 80, which tends to center the component within the housing during further insertion.

When the component (e.g. the piston or one of the end caps) is surrounded by an elastomeric seal, the outside diameter of the seal is less than the diameter of flared end 20, but larger than the inside diameter of the housing beyond ramp 80. Thus, insertion of a major component surrounded by a seal brings the uncompressed seal into contact with the housing along the ramp, and at that point tends to center the component relative to the housing. Upon further insertion of the component, the surrounding seal is compressed gradually, and in a balanced manner, i.e. to substantially the same degree at all circumferential locations. Housing 18 presents no comers or other sharp features that might damage the elastomeric seal as it is simultaneously compressed and moved inwardly along the interior surface of the housing.

The piston rod 32/piston 30 sub-assembly, including a piston seal 82 and wear ring 84, is assembled by insertion into the housing through flared end 20. Piston seal 82 is gradually compressed into the cylinder tube 18 by ramp 80 as explained above, with no discontinuities or shoulders present to damage the seal.

Blind end cap 28 with the blind end cap seal 42 is assembled in the same manner past flared end 20 and into housing 18. Blind end cap seal 42 is gradually compressed as it proceeds into the housing by ramp 80, with no discontinuities or shoulders present to damage the seal. The blind end cap is restrained by pressed in bearings or bushings 54/56 and clevis-type pin 66. The pin and bushings are removable to make the cylinder completely repairable with no loss of integrity due to disassembly or repair.

FIGS. 3 and 4 show SAE fitting port 44 for supplying fluid to the blind end of the cylinder and forcing the rod to extend. Flared end 20 isolates tube wall discontinuities, such as openings 56, 58 and 60 from the uncompressed seals 34 and 44 during assembly.

A load bearing surface 86 between rod 32 and rod cap 26 is maintained in concentric relation to a load bearing surface 88 between the housing and piston wear surface 34, and to a load bearing surface 90 between the rod cap 26 and the housing by controlling the process tolerances when manufacturing rod cap 26, piston 30 and rod 32. Alignment between the rod, the piston and the rod cap is assured directly by housing 18, with no tolerance build up that could lead to cylinder binding. Conventional fabrication of similar strength cylinders could lead to a tolerance build up in threaded cylinders or alignment challenges in the assembly, welding and cooling of welded cylinders.

Figure 6:
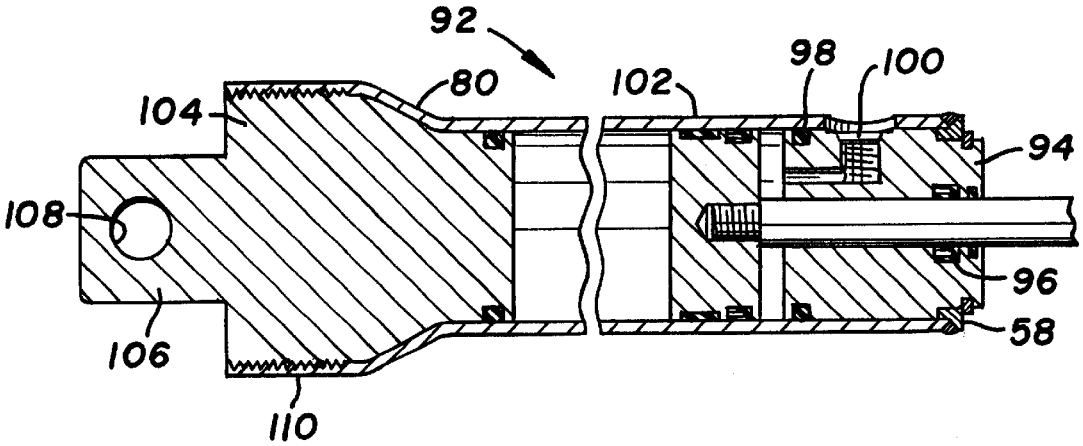
FIGS. 6, 7 and 8 are sectioned elevations of alternative embodiment actuators featuring double-acting cylinders and different approaches to securing end caps and providing pressurized fluid to an internal chamber.

FIG. 6 shows an actuator 92 with a double-acting cylinder configuration (force can be applied to both extend and retract). A rod end cap 94 includes a rod seal 96 and a cap seal 98 to contain fluid under pressure applied through a port 100. As before, rod end cap 94 is assembled through the flared end 20 of the housing with cap seal 98 being gradually compressed by the ramp 80. Discontinuities in a tube 102 caused by port 100 are avoided by assembly through the flared end 20. A piston 30 and a blind end cap 104 also are inserted into the housing at the flared end as previously described. End cap 104 includes an outward extension 106, with an opening 108 through the extension to permit a pivotal mounting of the actuator. In this embodiment the blind end cap is threadedly secured in the housing as indicated at 110, specifically through external threads formed in the end cap and corresponding internal threads formed in the housing. As before, rod cap 94 is retained by a rim 58 welded to the housing, and concentricity is assured by the cylindrical housing.

Figure 7:
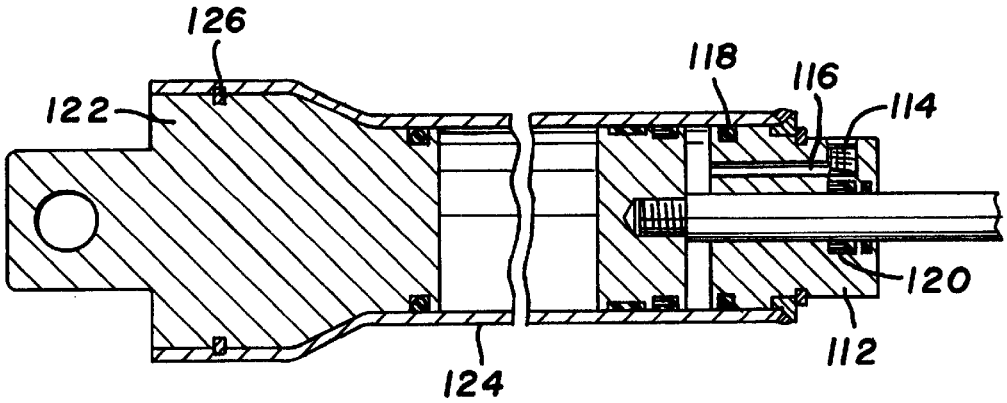

A rod cap 112 in FIG. 7 is another variation on rod caps 94 and 26, showing that the actuator can be altered to application specific configurations. In particular, a fitting 114 and passage 116 for providing fluid to the chamber are formed entirely through rod cap 112, avoiding any discontinuity (such as port 100) in the housing. With fluid provided between piston 30 and rod cap 112, the rod cap is provided with an elastomeric cap seal 118 and an elastomeric rod seal 120.

A blind end cap 122, similar in construction to blind end cap 104, is releasably secured within housing 124 by a snap ring 126 contained within a groove formed circumferentially around the blind end cap, with portions of the snap ring extending radially outwardly into internal grooves or slots formed in the housing. Although FIGS. 6 and 7 do not show a fitting and fluid passage into the chamber area between the blind end cap and piston, such passages are provided in the case of double-acting cylinders, and can either involve an opening through the housing, or entirely through the blind end cap.

Figure 8:
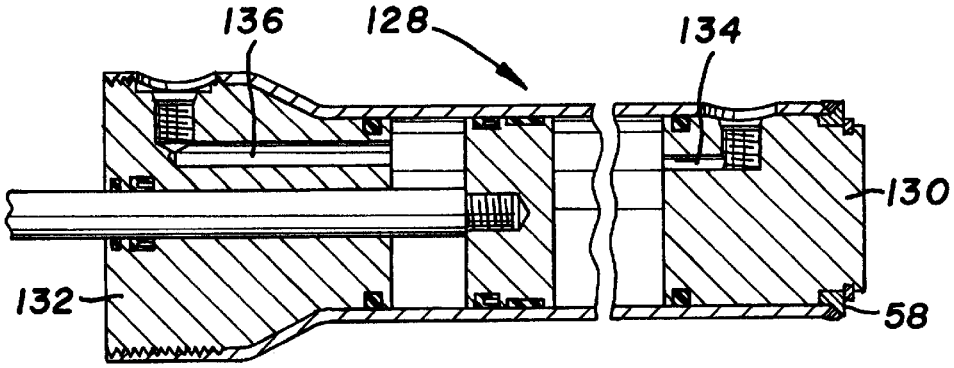

FIG. 8 illustrates a further alternative embodiment actuator 128 with a configuration that is reversed in the sense that a blind end cap 130 is contained by a welded annular rim 58 at the smaller-diameter end of the housing, while a rod cap 132 is contained within the flared end of the housing. The apparatus is double acting, with fluid passages 134 and 136 provided through the blind end cap and rod cap, respectively.

Figure 9:
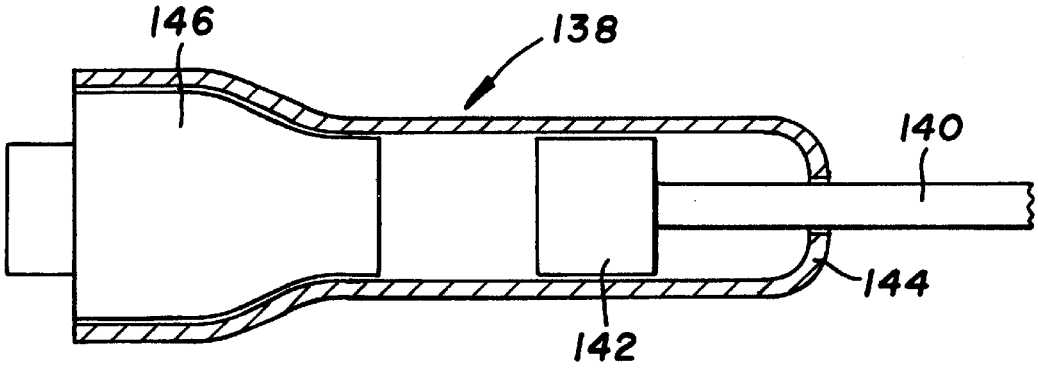
FIG. 9 is a schematic view of a further alternative embodiment actuator having a flared blind end to accommodate a blind end cap, and a wall providing the rod end.

FIG. 9 schematically illustrates a further alternative embodiment actuator 138 in which no rod end cap is provided. Instead, a piston rod 140, attached to a piston 142 that reciprocates within the housing, is slideably supported within a wall 144 that provides a closure at the smaller-diameter end of the housing. Wall 144 and the housing may be formed as a unit, or wall 144 can be welded to the end of the housing in the same manner as annular rim 58.

A blind end cap 146 is mounted within a flared region 24, releasably secured using a transversely extended pin and bushings, threads, or snap rings as previously described. The piston and blind end cap are inserted through the flared end as before, to better maintain the integrity of the elastomeric seals. One advantage of mounting blind end cap in the flared region, rather than the rod cap, is in preserving the option of a transverse opening and pin to pivotally mount the actuator and simultaneously secure the end cap. A rod end cap requires a central longitudinal bore to slideably accommodate the piston rod. Accordingly, the rod cap cannot accommodate a transverse opening such as opening 52 shown in FIG. 3.

Figure 10:
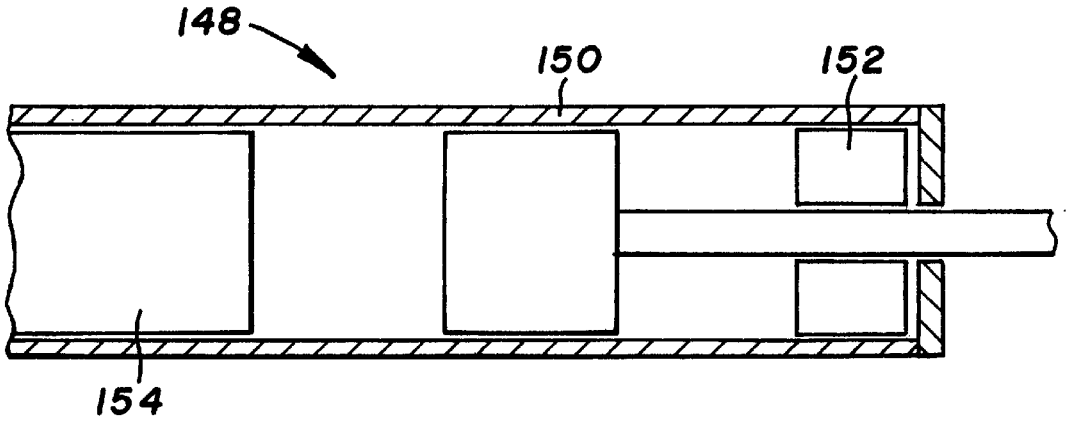
FIG. 10 is a schematic view of a further alternative embodiment actuator having a uniform diameter cylinder.

FIG. 10 illustrates a further alternative embodiment actuator 148 in which a housing 150 has a uniform diameter over its complete length. A rod cap 152 is retained by a welded annular rim and removable snap ring as before. At the opposite end of the housing is a blind end cap 154, equal in diameter to the rod cap. Any of the previously discussed methods can be employed to releasably retain the blind end cap. Actuator 148 affords the advantages of strength, ease of assembly and capability of disassembly without damage to the major components, found in previous embodiments. Due to the absence of a flared end region, more particularly a conical ramp or transition as in the previous embodiments, the assembly of actuator 148 requires more care to avoid damage to the elastomeric seals surrounding the piston and end caps.

Figure 13:
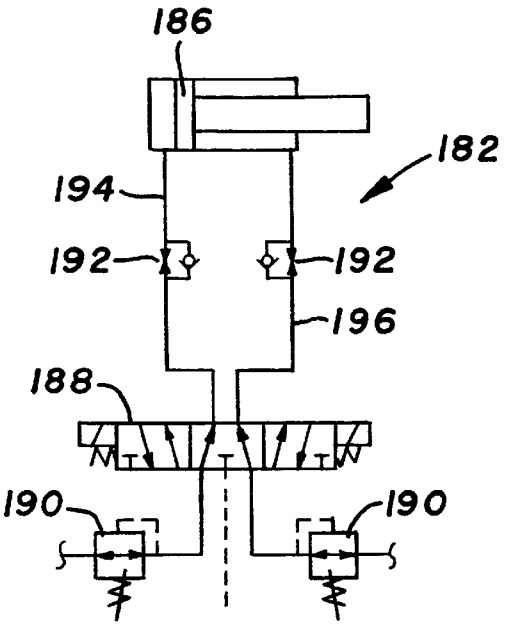
FIGS. 11—13 illustrate fluid actuator systems incorporating actuators of the present invention.
Figure 12:
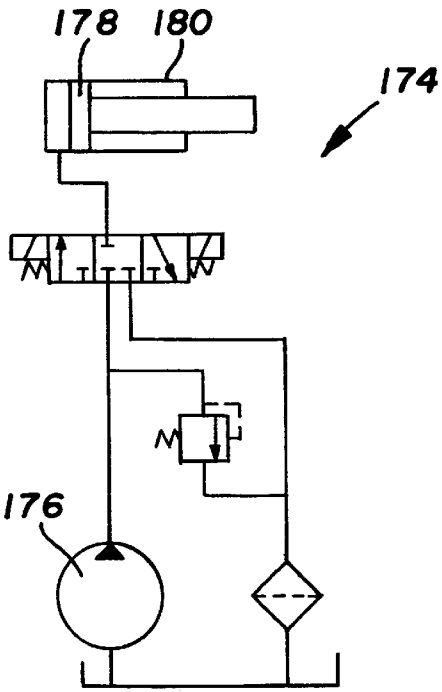
Figure 11:
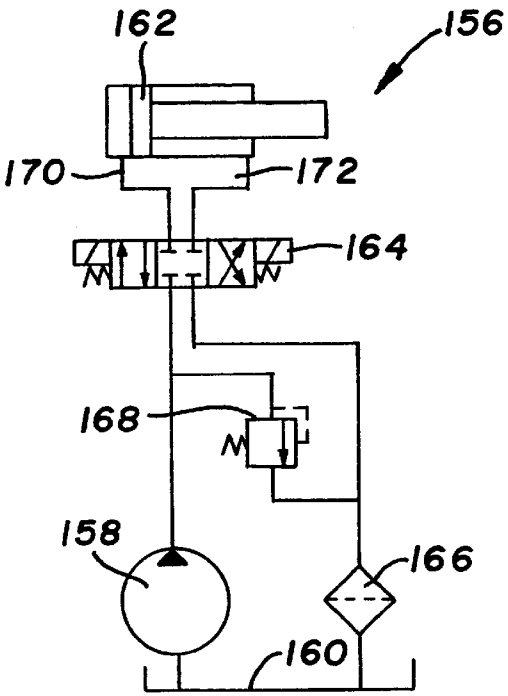

FIGS. 11–13 illustrate systems in which fluid actuators constructed according to the present invention may be employed. FIG. 11 illustrates a double-acting system 156 in which a pump 158 supplies hydraulic fluid from a reservoir 160 to either side of a piston 162, as selected by a directional valve 164. The hydraulic fluid is returned to the reservoir through a filter 166. A relief valve 168 is provided between a supply line 170 and a return line 172.

FIG. 12 shows a single-acting system 174 in which a pump 176 supplies hydraulic fluid to one side of a piston 178 of a single. acting cylinder 180 to extend the cylinder. The piston and rod are returned by gravity.

FIG. 13 illustrates a double-acting pneumatic system 182 in which air is supplied from a pressurized source 184, selectively to either side of the piston 186 through a directional valve 188. An air regulator 190 and lockout speed adjust 192 are provided in connection with the lines 194 and 196 to each side of the piston.

Thus in accordance with the present invention, all internal components of a fluid actuator are assembled through one end of the housing, preferably an enlarged flared end. This provides a clearance between the elastomeric seals in their relaxed state when surrounding the internal components, and the housing wall, and further provides a gradual and smooth compression of the seals during assembly, without the need for cumbersome assembly fixtures or appliances. The first end cap inserted is moved along the complete length of the housing to an end region with a diameter smaller than that of the flared end, where a welded rim retains the end cap. Internal components can be precisely machined and concentrically aligned with one another through their concentricity with the housing, eliminating a buildup of tolerances found in conventional assembly approaches. The end result is a fluid actuator that is easier and less costly to manufacture and assemble, yet exhibits higher capacity, improved reliability and seal integrity.

What is claimed is:

1. An actuator enclosure for containing a reciprocating piston; including:

a cylindrical housing defining a chamber including a first end region, a second end region opposite the first end region and including an open end of the housing, and a medial region between the first and second end regions;

a first end closure member insertable in a first axial direction into the chamber through the open end, and shaped for a conforming and contiguous surface engagement with the housing at a first predetermined location along the first end region;

a second end closure member insertable in the first axial direction into the chamber through the open end, and shaped for a conforming and contiguous surface engagement with the housing at a second predetermined location along the second end region; and a closure member containing structure integral with the housing and positioned to engage the first closure member substantially upon a complete insertion thereof to the first predetermined location, thereby to prevent further travel of the first closure member in the first axial direction, the closure member containing structure including an annular rim extended radially inwardly from the housing and disposed at least proximate the first end region of the chamber;

wherein the housing is adapted to accommodate a piston for reciprocation along the medial region of the chamber, and a selected one of the first and second closure members includes an opening adapted to slideably support a piston rod coupled to the piston.

2. The enclosure of claim 1 wherein:

said annular rim is welded to an edge of the housing adjacent the first end region.

3. The enclosure of claim 1 further including:

a first closure member mounting device for securing the first end closure member with respect to the housing at the first predetermined location.

4. The enclosure of claim 3 wherein:

the first closure member mounting device includes a retaining structure for releasably securing the first end closure member against movement away from the first predetermined location in a second axial direction opposite to the first axial direction.

5. The enclosure of claim 4 wherein:

a portion of the first end closure member extends beyond the first end region of the housing when in the first predetermined location, and the retaining structure includes a groove formed circumferentially about the first closure member and a retaining ring removably mounted within the groove.

6. The enclosure of claim 3 further including:

a second closure member mounting device for releasably securing the second end closure member with respect to the housing at the second predetermined location.

7. The enclosure of claim 6 wherein:

the second closure member mounting device comprises a first opening formed in the second end closure member, at least one second opening formed through the housing along the second end region and positioned for an alignment with the first opening when the second end closure member is at the second predetermined location, and a pin insertable through the first and second openings to maintain said alignment.

8. The enclosure of claim 7 wherein:

the first opening extends through the second end closure member, the at least one second opening comprises two second openings on opposite sides of the housing, and the pin is insertable simultaneously through the first opening and both of the second openings to maintain said alignment.

9. The enclosure of claim 8 further including:

first and second bushings each inserted into the first opening through one of said second openings, and disposed in surrounding relation to the pin.

10. The enclosure of claim 6 wherein:

the second closure member mounting device comprises external threads formed about the second closure member, and corresponding internal threads formed in the housing along the second end region.

11. The enclosure of claim 6 wherein:

the second closure member mounting device comprises a groove formed in the second closure member, at least one slot formed through the housing and positioned for an alignment with the groove when the second closure member is at the second predetermined location, and a retaining ring releasably insertable through the slot and into the groove.

12. The enclosure of claim 1 wherein:

the first end region of the chamber has a first diameter, and the second end region at least along a portion thereof near the open end has a second diameter larger than the first diameter.

13. The enclosure of claim 12 wherein:

the medial region of the chamber has a third diameter substantially equal to the first diameter.

14. The enclosure of claim 13 wherein:

the housing incorporates a flared portion extending from the medial region to said portion of the second end region to provide a gradual transition from the first diameter to the second diameter.

15. The enclosure of claim 12 wherein:

the first end closure member is said selected one of the closure members and consists essentially of a rod end cap; and the second end closure member consists essentially of a blind end cap.

16. The enclosure of claim 1 further including:

a closure member mounting device for releasably securing the second end closure member with respect to the housing at the second predetermined location.

17. The enclosure of claim 16 wherein:

the closure member mounting device comprises a first opening formed into the second end closure member, a second opening formed through the housing along the second end region and positioned for an alignment with the first opening when the second end closure member is at the second predetermined location, and a pin insertable through the first and second openings for maintaining said alignment.

18. The enclosure of claim 1 wherein:

said selected one of the end closure members is the first end closure member.

19. The enclosure of claim 1 wherein:

said selected one of the end closure members is the second end closure member.

20. The enclosure of claim 1 further including:

a piston mounted to reciprocate along the medial region of the chamber, and a fluid passage open to the medial region between the piston and one of the end closure members for supplying a fluid under pressure to the chamber.

21. The enclosure of claim 20 wherein:

said selected one of the closure members is the first end closure member, and the fluid passage is open to the chamber between the piston and the second end closure member.

22. The enclosure of claim 21 further including:

a second fluid passage open to the medial region of the chamber between the piston and the first end closure member for supplying a fluid under pressure to the chamber.

23. The enclosure of claim 22 wherein:

the first fluid passage is formed through the second end closure member, and the second fluid passage is formed through the first end closure member.

24. The enclosure of claim 20 wherein:

the fluid passage is formed through said one of the end closure members.

25. The enclosure of claim 1 wherein:

the first end closure member, the piston, and the second end closure member are insertable in succession through said open end, respectively to the first predetermined location, the medial region, and the second predetermined location.

26. The enclosure of claim 1 wherein:

said closure member containing structure further is adapted to prevent an insertion of the first end closure member into the chamber in a second axial direction opposite the first axial direction.

27. A fluid actuator including the actuator enclosure of claim 1, and further including:

a piston contained inside the housing for reciprocation along the medial region;

a first closure member mounting device for securing the first end closure member at the first predetermined location;

a second closure member mounting device for securing the second closure member at the second predetermined location; and a piston rod secured to the piston and extending axially through the selected end closure member to a piston rod termination outside of the housing.

28. A fluid actuator system including the fluid actuator of claim 27 and further including:

a fluid source containing a fluid;

a first supply line fluid coupled to the source and to the medial region of the chamber at a first location;

a pump fluid coupled along the supply line for providing the fluid under pressure to the chamber; and a directional valve fluid coupled along the supply line, for permitting, alternatively, the supplying of the fluid to the chamber and the evacuation of the fluid from the chamber.

29. The system of claim 28 further including:

a second supply line for supplying the fluid to the intermediate region of the chamber at a second location on an opposite side of the piston from the first location.

30. The system of claim 28 wherein:

the fluid comprises a hydraulic fluid.

31. A fluid actuator, including:

a cylindrical housing defining a chamber including a first region adjacent an open end of the housing, and a second region adjacent an opposite end of the housing;

wherein the first region, at least along a portion thereof near the open end, has a first diameter, and the second region of the chamber has a second diameter less than the first diameter;

wherein the housing incorporates a transition region extending from the second region to said portion of the first region to provide a gradual transition from the second diameter to the first diameter;

a first end closure member insertable in a first axial direction into the chamber through the open end, and shaped for a conforming and contiguous surface engagement with the housing along the first region and along the transition region to position the first end closure member at a first predetermined location with respect to the cylindrical housing; and a closure structure for closing the housing at said opposite end thereof;

where and the closure structure includes an opening there through.

32. The actuator of claim 31 further including:

a closure member mounting device for releasably securing the first end closure member with respect to the housing at the first predetermined location.

33. The actuator of claim 32 wherein:

the closure member mounting device comprises a first opening formed into the first end closure member, at least one second opening formed through the housing along the first region and positioned for an alignment with the first opening when the first end closure member is at the first predetermined location, and a pin insertable through the first and second openings for maintaining said alignment.

34. The actuator of claim 33 wherein:

the first opening extends through the first end closure member, the at least one second opening comprises two second openings on opposite sides of the housing, and the pin is insertable simultaneously through the first opening and both of the second openings to maintain said alignment.

35. The actuator of claim 34 further including:

first and second bushings each inserted into the first opening through one of said second openings, and disposed in surrounding relation to the pin.

36. The actuator of claim 31 wherein:

said closure structure comprises a second end closure member shaped for a conforming and contiguous surface engagement with the housing at a second predetermined location along the second region near said opposite end.

37. The actuator of claim 36 wherein:

the second end closure member is insertable in said first axial direction into the chamber through the open end.

38. The actuator of claim 37 further including:

a closure member containing structure integral with the housing and positioned to engage the second end closure member substantially upon a complete insertion thereof to the second predetermined location, thereby to prevent further travel of the second end closure member in the first axial direction.

39. The actuator of claim 38 wherein:

the closure member containing structure includes an annular rim extended radially inwardly from the housing and disposed at least proximate said second end.

40. The actuator of claim 39 wherein:

the annular rim is welded to the housing at said second edge.

41. The actuator of claim 38 wherein:

said closure member containing structure further is adapted to prevent an insertion of the second end closure member into the chamber in a second axial direction opposite the first axial direction.

42. The actuator of claim 36 further including:

a closure member mounting device for securing the second end closure member with respect to the housing at the second predetermined location.

43. The actuator of claim 42 wherein:

the closure member mounting device includes a retaining structure for releasably securing the second end closure member against movement away from the second predetermined location in a second axial direction opposite to the first axial direction.

44. The actuator of claim 31 further including:

a piston mounted to reciprocate along the second region of the chamber piston rod mounted slideably in said opening and coupled to reciprocate with the piston, and a fluid passage open to the second region between the piston and the first end closure member for supplying a fluid under pressure to the chamber.

45. The actuator of claim 44 further including:

a second fluid passage open to the second region of the chamber between the piston and the closure structure for supplying a fluid under pressure to the chamber.

46. A process for assembling a fluid actuator, including:

providing a cylinder having first and second opposite open ends, a first diameter over a majority of its length including said first end, a second diameter larger than the first diameter along an end region of the cylinder including the second end, and a transition region providing a gradual transition between the First diameter and the second diameter;

securing an end cap containment feature proximate the first end of the cylinder;

inserting a first end cap into the cylinder through the second end, and moving the first end cap in a first axial direction along the cylinder until it contacts the containment feature and substantially closes the first end upon reaching a first predetermined location;

after so inserting the first end cap, inserting a piston into the cylinder through the second end, and moving the piston in said first axial direction to a location beyond said transition region;

after so inserting the piston, inserting a second end cap into the cylinder through the second end to a second predetermined location to substantially close said second end; and extending the piston rod from the piston, through an opening provided through a selected one of the end caps, to a piston rod termination outside of the cylinder.

47. A fluid actuator, including:

a cylindrical housing defining a chamber including a first region adjacent an open end of the housing, a second region adjacent an opposite end of the housing, and a medial region between the first and second regions;

a closure structure for closing the housing at said opposite end thereof;

a first end closure member insertable in a first axial direction into the chamber through the open end, and shaped for a conforming and contiguous surface engagement with the housing; and a closure member mounting device for releasably securing the first end closure member with respect to the housing at a first predetermined location along the first region, including a first opening formed into the first end closure member, at least one second opening formed through the housing along the first region and positioned for an alignment with the first opening when the first end closure member is at the first predetermined location, and a pin insertable through the first and second openings for maintaining said alignment.

48. The actuator of claim 47 wherein:

the first opening extends through the first end closure member, the at least one second opening comprises two diametrically opposed second openings through the housing, and the pin is insertable simultaneously through the first opening and both of the second openings to maintain said alignment.

49. The actuator of claim 48 further including:

first and second bushings, each inserted into the first opening through one of the second openings and disposed in surrounding relation to the pin.

50. The actuator of claim 47 wherein:

the closure structure comprises a second end closure member insertable in the first axial direction into the chamber through the open end, and shaped for a conforming and contiguous surface engagement with the housing at a second predetermined location along the second region near the opposite end.

51. The actuator of claim 50 further including:

a closure member containing structure integral with the housing and positioned to engage the second end closure member substantially upon a complete insertion thereof to the second predetermined location, and further adapted to prevent an insertion of the second end closure member into the chamber in a second axial direction opposite the first axial direction.

52. The actuator of claim 47 wherein:

the first region has a first diameter, and the second region and the medial region have a second diameter less than the first diameter; and the housing incorporates a transition region extending from the medial region to the first region to provide a gradual transition from the second diameter to the first diameter.

53. An actuator enclosure for containing a reciprocating piston, including:

a cylindrical housing defining a chamber including a first end region, a second end region opposite the first end region and including an open end of the housing, and a medial region between the first and second end regions;

a first end closure member insertable in a first axial direction into the chamber through the open end, and shaped for a conforming and contiguous surface engagement with the housing at a first predetermined location along the first end region;

a second end closure member insertable in the first axial direction into the chamber through the open end, and shaped for a conforming and contiguous surface engagement with the housing at a second predetermined location along the second end region; and a closure member containing structure non-removably fixed with respect to the housing and positioned to engage the first closure member substantially upon a complete insertion thereof to the first predetermined location, thereby to prevent further travel of the first closure member in the first axial direction;

wherein the housing is adapted to accommodate a piston for reciprocation along the medial region of the chamber, and a selected one of the first and second closure members includes an opening adapted to slideably support a piston rod coupled to the piston.

54. The enclosure of claim 53 wherein:

the closure member containing structure includes an annular rim extended radially inwardly from the housing and disposed at least proximate the first end region of the chamber.

55. The enclosure of claim 54 wherein:

the annular rim is welded to an edge of the housing adjacent the first end region.

56. The enclosure of claim 53 further including:

a retaining structure for releasably securing the first end closure member against movement away from the first predetermined location in a second axial direction opposite to the first axial direction.

57. The enclosure of claim 56 wherein:

a portion of the first end closure member extends beyond the first end region of the housing when the first end closure member is at the first predetermined location, and the retaining structure includes a groove formed circumferentially about the first end closure member and a retaining ring removably mounted within the groove.

58. The enclosure of claim 53 wherein:

the first end region and the medial region have a first diameter, the second end region has a second diameter larger than the first diameter, and the housing incorporates a flared portion extending from the medial region to the second end region to provide a gradual transition from the first diameter to the second diameter.

59. A fluid actuator including:

a cylindrical housing defining a chamber including a first end region, a second end region opposite the first end region and including an open end of the housing, and a medial region between the first and second end regions;

a first end closure member insertable in a first axial direction into the chamber through the open end, and shaped for a conforming and contiguous surface engagement with the housing at a first predetermined location along the first end region;

an annular flexible first seal surrounding the first end closure member and adapted to be compressed between the first end closure member and the housing when the first end closure member is at the first predetermined location;

a piston insertable in the first axial direction into the chamber through the open end for reciprocation along the medial region;

an annular flexible piston seal surrounding the piston and adapted to be compressed between the piston and the cylindrical housing when the piston is disposed in the medial region;

a second end closure member insertable in the first axial direction into the chamber through the open end, and shaped for a conforming and contiguous surface engagement with the housing at a second predetermined location along the second end region;

an annular flexible second seal surrounding the second end closure member and adapted to be compressed between the cylindrical housing and the second end closure member when the second end closure member is at the second predetermined location; and a first fluid passage formed through a selected one of the end closure members and open to the medial region between the selected end closure member and the piston.

60. The actuator of claim 59 wherein:

the selected one of the end closure members is the second end closure member.

61. The actuator of claim 60 further including:

a closure member mounting device for releasably securing the second end closure member with respect to the housing at the second predetermined location.

62. The actuator of claim 61 wherein:

the closure member mounting device comprises a first opening formed in the second end closure member, at least one second opening formed through the housing along the second end region and positioned for an alignment with the first opening when the second end closure member is at the second predetermined location, and a pin insertable through the first and second openings to maintain said alignment.

63. The actuator of claim 59 further including:

a second fluid passage formed through the one of said end closure members other than the selected one, and open to the medial region between said other one and the piston.

64. The actuator of claim 59 wherein:

the first end closure member, the piston, and the second end closure member are insertable in succession through said open end, respectively to the first predetermined location, the medial region, and the second predetermined location.

65. The actuator of claim 59 further including:

a closure member containing structure integral with the housing and positioned to engage the first closure member substantially upon a complete insertion thereof to the first predetermined location to prevent further travel of the first closure member in the first axial direction, and further adapted to prevent an insertion of the first end closure member into the chamber in a second axial direction opposite the first axial direction.

66. The actuator of claim 59 wherein:

the first end region and the medial region have a first diameter, the second end region has a second diameter larger than the first diameter, and the housing incorporates a flared portion extending from the medial region to the second end region to provide a gradual transition from the first diameter to the second diameter.

67. The actuator of claim 66 wherein:

the second end closure member includes a medial portion shaped for a conforming and contiguous surface engagement with the flared portion of the housing, and an inner end portion confronting the medial region adjacent to flared portion when the second end closure member is at the second predetermined location; and the second seal surrounds the inner end portion of the second end closure member.

* * * * *